US005970553A

United States Patent [19]

Lin

[11] Patent Number: 5,970,553

[45] Date of Patent: Oct. 26, 1999

[54] WRENCH HAMMER SET

[76] Inventor: Yuan-Ho Lin, No. 22, Chiao-Chien Rd., Chien-Min Li, Ta-Li City, Taichung Hsien, Taiwan

[21] Appl. No.: 09/090,318

[22] Filed: Jun. 4, 1998

[51] Int. Cl.[6] ..... B25D 1/04

[52] U.S. Cl. ..... 7/143; 7/139; 7/168

[58] Field of Search ..... 7/143, 138, 139, 7/167, 168

[56] References Cited

U.S. PATENT DOCUMENTS

| | | | |
|---|---|---|---|
| 854,891 | 5/1907 | Huffman | 7/168 |
| 4,204,294 | 5/1980 | Halverson | 7/168 |
| 5,428,853 | 7/1995 | Menke et al. | 7/143 |
| 5,685,206 | 11/1997 | Ma | 7/139 |
| 5,787,535 | 8/1998 | Epstein | 7/168 |

*Primary Examiner*—David A. Scherbel
*Assistant Examiner*—Joni B. Danganan
*Attorney, Agent, or Firm*—Bacon & Thomas

[57] ABSTRACT

A wrench hammer set, comprising a handle rod, one end of said handle rod is linked to a combination tool head that serves as an adjustable wrench and a hammer; the other end of said handle rod is linked to a rod-shaped tool set; a handle cover covering the rear half of said handle rod, to serve as a handle of a hand tool set, inside said handle cover may be arranged an assortment of sleeve sockets; with said construction, tools of various functions are combined to become a hand tool, to fully achieve the purposes of minimized space and increased functions.

5 Claims, 6 Drawing Sheets

WRENCH HAMMER SET

BACKGROUND OF THE INVENTION

The invention is related to a wrench hammer set, or more specifically, a wrench hammer set with the combination of an adjustable wrench, a hammer, sleeve sockets, screwdrivers, etc., to enable multiple functions in a wrench hammer set.

Using various different hand tools has become a regular job in assembling and disassembling processes, a number of hand tools with a same function but with different specifications are required for various sizes. Therefore, the portability of hand tools has always been an objective for improvement by researchers, the most simple solution is to be able to incorporate all necessary hand tools in a tool box, but the capacity of a tool box is limited, if many hand tools are designed as individual pieces with single functions, the variety of hand tools that can be put in a tool box will be quite limited, and in case each hand tool involves a handle, it will occupy a much larger space, but if the solution is aimed at increasing the cubic measurements and space of a tool box, it will not only fail to really solve the problem, but will also increase the burden of carrying it. Therefore, current solutions are aimed at the design of wrench hammer sets, with the hope to include more sets of tools with different functions on a same hand tool in order to save the space, so that with the cubic measurements of a conventional single piece of single-function hand tool, various tool functions may be achieved, so that it will be convenient and fast to carry, operate, use or accommodate the tools.

SUMMARY OF THE INVENTION

The primary objective of the present invention is to present a type of wrench hammer set, by combining various tools in a same hand tool set, such as adjustable wrench, hammer, screwdriver, sleeve sockets, etc., so that it will achieve the objectives of multiple application functions, minimized occupation of space and increased performance.

The application technology to achieve the above objective:

The invention relates to the linking of a wrench hammer set at one end of a handle rod, to serve as an adjustable wrench and a hammer; the other end of said handle rod is linked to a rod-shaped tool set; a handle cover covering the rear half of said handle rod, serving as a handle of the hand tool set, inside said handle cover may be arranged an assortment of sleeve sockets, one of them can be selected to fit on a rod-shaped tool set, said construction so designed to achieve the purpose of combining the functions of adjustable wrench, hammer, screwdriver and sleeve sockets in a same hand tool.

DETAILED DESCRIPTION OF PREFERRED EMBODIMENT

Figure 4:
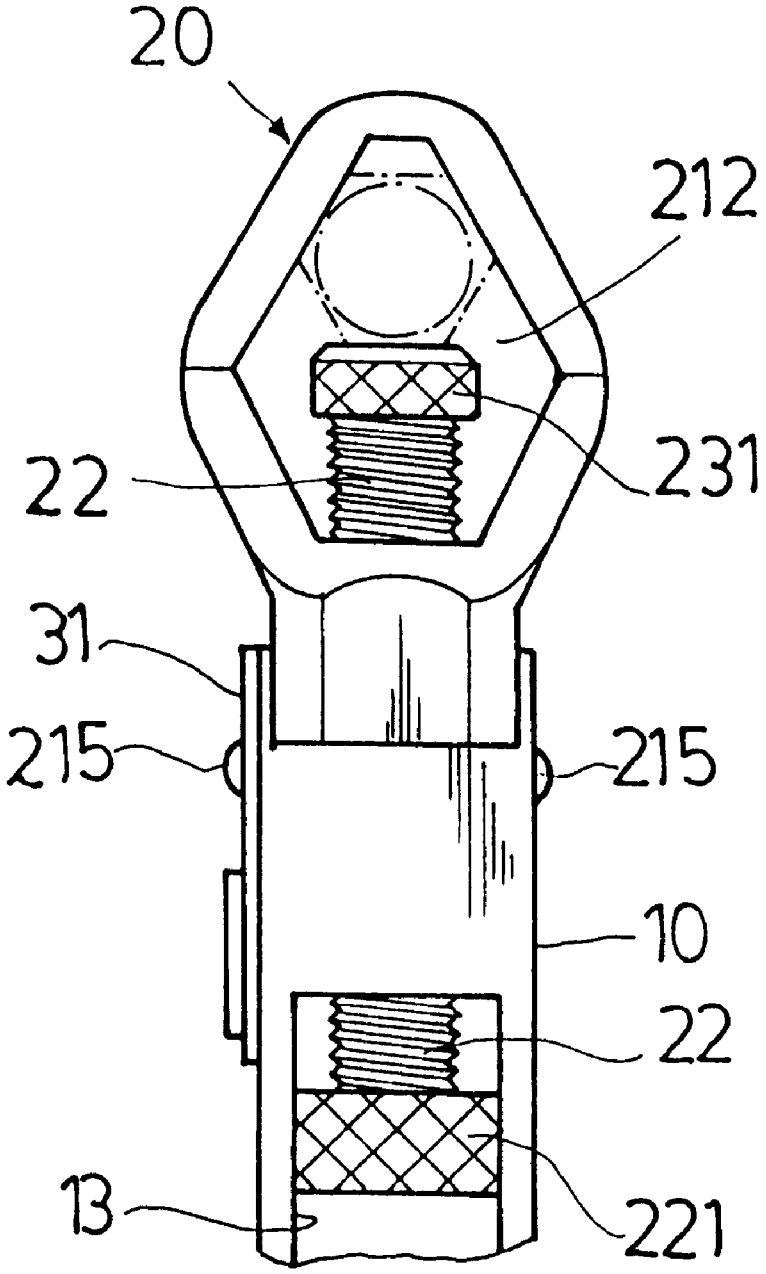
FIG. 4 is a view of the invention of wrench hammer set for application as an adjustable wrench.

Please refer to FIGS. 1 through 3B; the invention of wrench hammer set comprises:

a handle rod 10, so configured that a side wall 12 is erected at the bend of each of two sides of a horizontal rod plate 11;

a combination tool head 20 one end of which being a joining part 211, the other end being a hollow angular socket 212; a long the axis of said joining part 211 being a screw hole 213, to be screwed to an adjusting bolt 22 with an outside thread, one end of said adjusting bolt 22 being a hammer block 221 with an expanded diameter, at the other end along its axis being a small screw hole 222, into which is screwed a pushing bolt 23 with an outside thread, the outside end of said pushing bolt 23 being a pushing block 231; on each of two sides of said joining part 211 being a small screw hole 214, on the side wall 12 near the end of said handle rod 10 being a hole 121, to facilitate the penetration by a screw unit 215, to link said combination tool head 20 to the end of said handle rod 10; on the rod plate 11 of said handle rod 10 corresponding to the location of said adjusting bolt 22 being an opening 13, where the hammer block 221 of said adjusting bolt 22 may be exposed, thereby the user may turn said hammer block 221 in said opening 13, to move said adjusting bolt 22 forward or backward, so its pushing block 231 will coordinate with said socket 212, to form different spaces to accommodate different work pieces and serve as an adjustable wrench (as shown in FIG. 4); near one end on one side of said joining part 211 being a round groove 216, in which being squeezed a spring 217 and a round ball 218; on the side wall of said handle rod 10 corresponding to the position of said round ball 218 being a small round hole 14, when said combination tool head 20 and said handle rod 10 are extended horizontally, said round ball 218 will be limited and positioned in said small round hole 14;

a positioning structure 30, involving a slide plate 31 that is located on the outside of one side wall of said handle rod 10, on the front end of said slide plate 31 corresponding to the location of said screw unit 215 being an elongated hole 32 for its insertion, the rear end protrudes outward from the inside wall to form a filling groove 33 which opens to the inside, inside said filling groove 33 being fixed an end of a spring 34 that is horizontally positioned; the other end of said spring 34 being fixed to a hook hole 122 on said side wall 12; on the front end of said slide plate 31 corresponding to the open end of said side wall 12 being a catch plate 35; near the end of the joining part 211 of said combination tool head 20 corresponding to the side of said positioning structure 30 being erected a catch groove 24.

Figure 1:
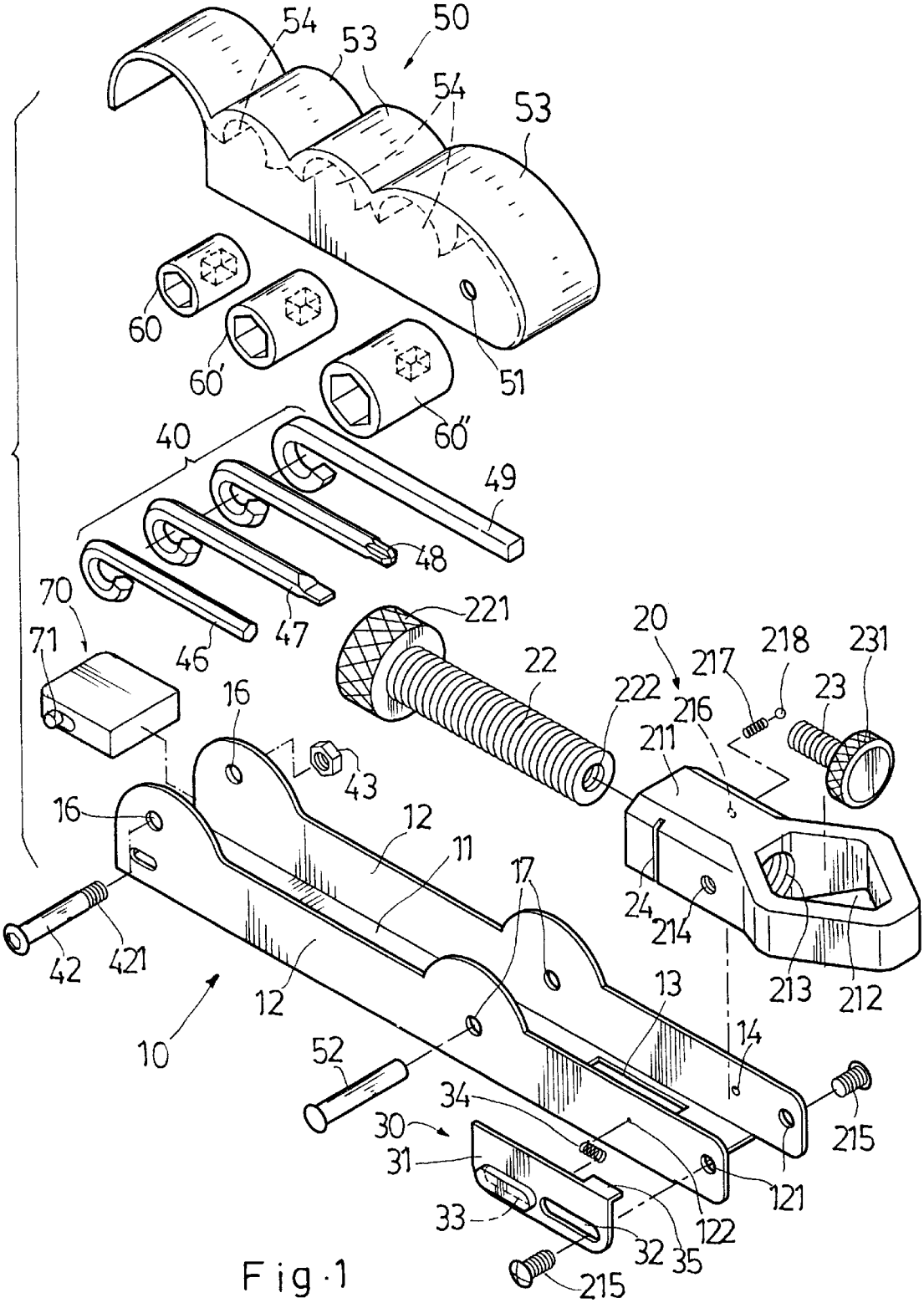
FIG. 1 is an exploded view of the invention.
Figure 2:
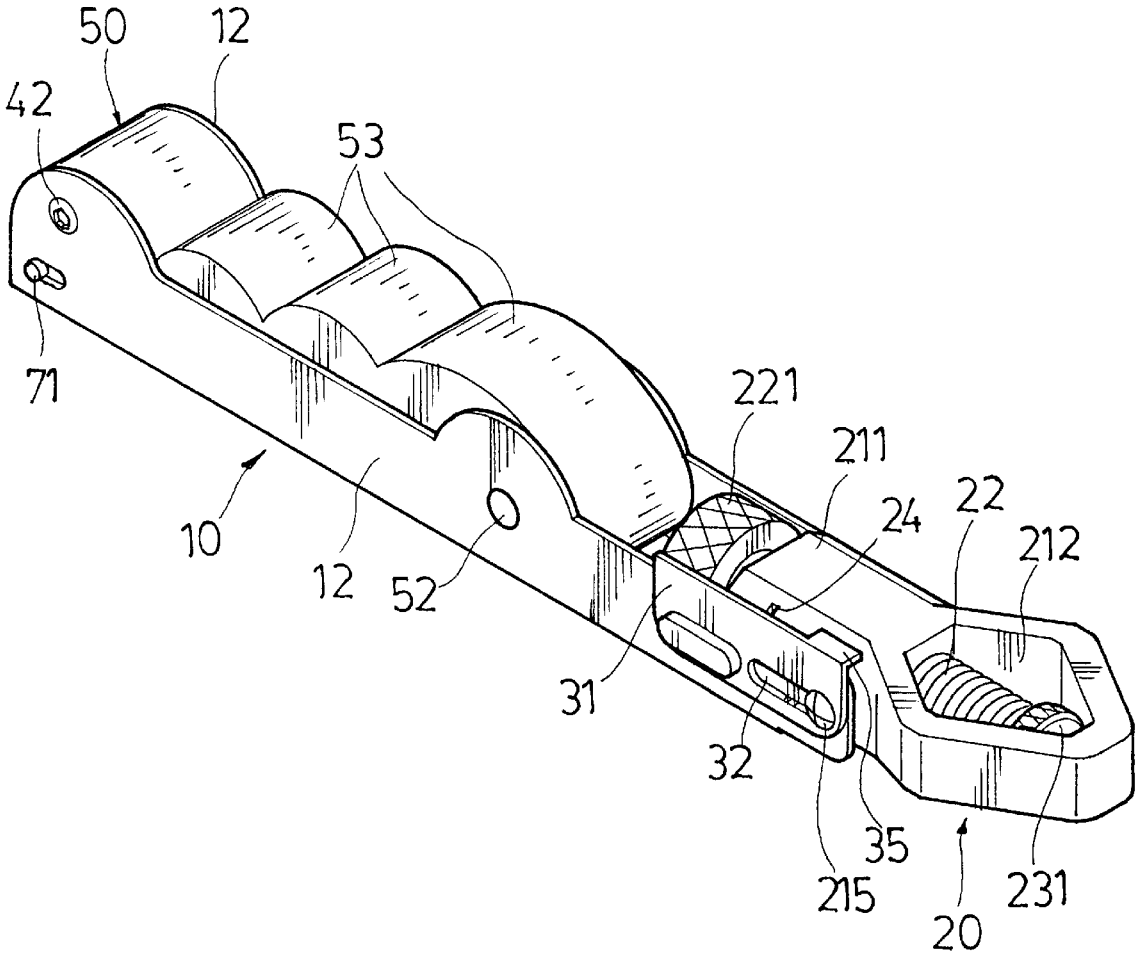
FIG. 2 is a perspective assembled view of the invention.
Figure 3A:
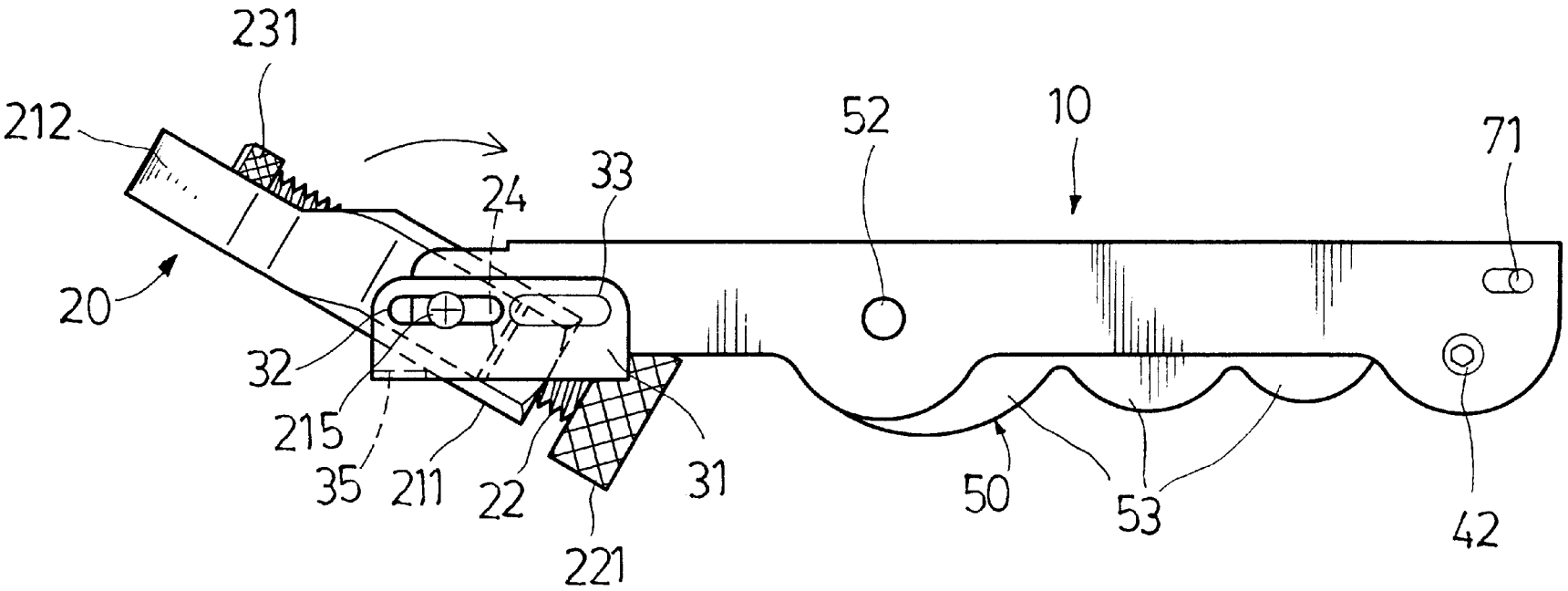
FIG. 3A is a view of the invention of wrench hammer set for application as a hammer.
Figure 3B:
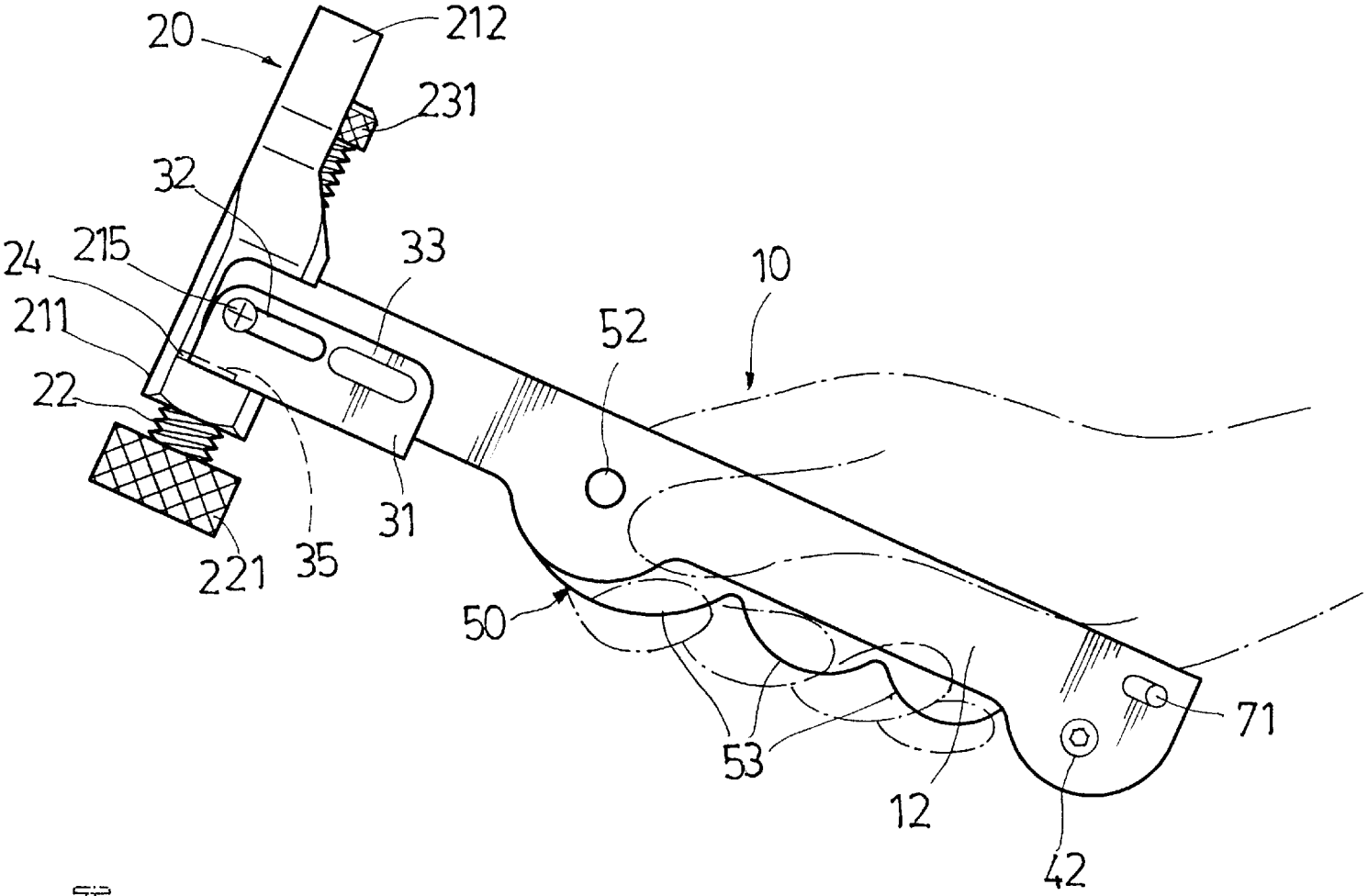
FIG. 3B is a view of the invention of wrench hammer set for application as a hammer.

By means of said positioning structure 30, said combination tool head 20 may be rotated to form a straight angle with said handle rod 10, which operation is illustrated in FIGS. 3A and 3B. Said slide plate 31 is pushed forward for a distance, to the extent that said catch plate 35 will not obstruct said combination tool head 20, so said combination tool head 20 turned to form a straight angle with the handle rod 10, the hammer block 221 of said adjusting bolt 22 facing downward, then said slide plate 31 is released, the resilience of the spring 34 inside will bring it to move back to position, meanwhile, since said combination tool head 20 is turned to an upright position, its catch groove 24 will become horizontal and aligned to said catch plate 35, when said slide plate 31 retreats, said catch plate 35 will slide into said catch groove 24, then said combination tool head 20 will erected to serve as a hammer which hammer block 221 serves to hammer a work piece, but as a principle, said adjusting bolt 22 must be adjusted to the front, so said pushing bolt 23 is pushing the inside wall of the socket part 212, and said adjusting bolt 22 will have sufficient force to perform its hammering function.

Figure 5:
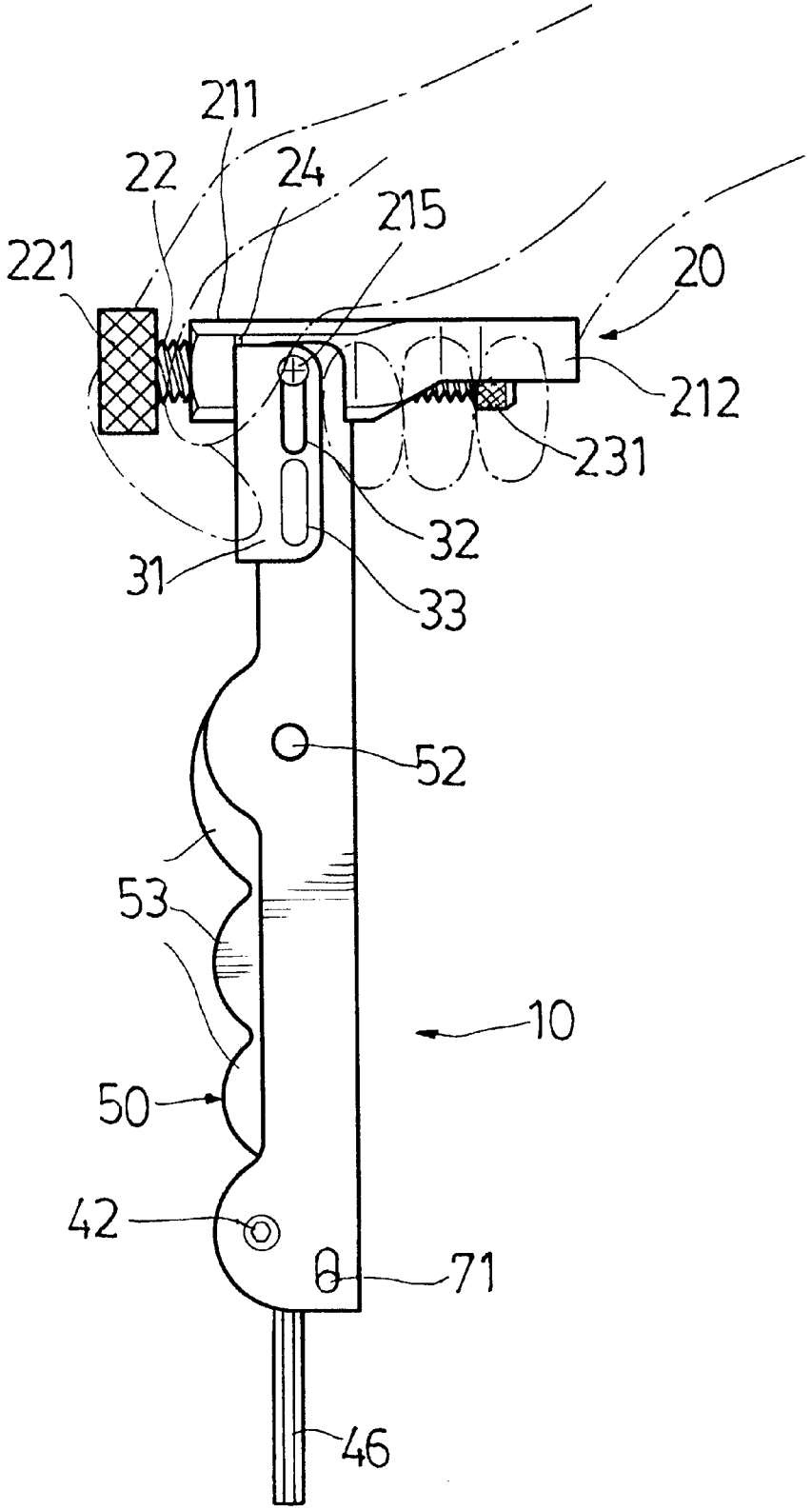
FIG. 5 is a view of t he invention of wrench hammer set.

A rod-shaped combination set 40, composed of a number of rod-shaped tools which end parts are linked to a bolt rod 42, said bolt rod 42 penetrating the fixing hole 16 on the side wall at the end of said handle rod 10, on its end is a thread 421, where a nut 43 will fasten said bolt rod 42; said rod-shaped combination tool set 40 comprises a socket rod 49, a slot-head screwdriver rod 47, a Philip-head screwdriver rod 48 and an angle rod screwdriver 46; any one rod-shaped tool in said rod-shaped tool set 40 can be unfolded outward to extend said handle rod 10 for the execution of screw tightening or loosening operation, or it can be folded inward to be accommodated in said handle rod 10; when said rod-shaped tool set 40 is executing loosening or tightening operation (as illustrated in FIG. 5), said combination tool head 20 is unfolded to form a straight angle with the handle rod 10, then the tool handle becomes T-shaped, so that the user's hand will be able to grip said combination tool head 20, to apply force to turn the whole tool set.

A handle cover 50, a hollow structure, its side corresponding to said handle rod 10 being opened; on the side wall at the end of said handle cover 50 corresponding to said combination tool head 20 being a joining hole 51, on the side wall near its middle section of said handle rod 10 being a bolt hole 17, to be penetrated by a bolt post 52, said handle cover 50 can be folded to or unfolded from the rear half of said handle rod 10; on the outside surface of said handle cover 50 being a number of arched sections 53, so designed that said handle cover 50 can tightly cover the inside of the rear half of said handle rod 10 to form a handle to be gripped by the user, while said arched sections 53 will enable more comfortable operation to the user; on the inside of said handle cover 50 corresponding to respective arched sections 53 being a number of semi-round recessed accommodating grooves 54, to accommodate a number of conventional sockets 60, 60', 60" of various specifications, and said several accommodating grooves 54 being arranged sequentially according to their sizes from the end of said handle cover 50, to facilitate the accommodation of said rod-shaped tool set 40; said each sleeve socket 60, 60', 60" may be fitted to the sleeve rod 49 of said rod-shaped tool set 40;

an illumining structure 70, which interior construction and interior battery device are conventional technology that are not the main points of the subject matter, so they need no elaboration, said illumining structure 70 is fitted to the lower part of said rod-shaped tool set 40, its switch 71 is visible on said handle rod 10.

I claim:

1. A wrench hammer set, comprising:

a handle rod, including a side wall erected at each of two sides of a horizontal rod plate;

a combination tool head, one end of which being a joining part, the other end being a hollow angular socket; said joining part being screwed to an adjusting bolt, one end of the adjusting bolt including a hammer block, the other end of the adjusting bolt being screwed to a pushing bolt, on the outside end of said pushing bolt is a pushing block; said joining part of said combination tool head being pivotally attached to a first end of said handle rod; on the rod plate of said handle rod corresponding to the location of said adjusting bolt is an opening where said hammer block may be exposed;

a positioning structure comprising a slide plate is located on the outside of one of the side walls of said handle rod, on the front end of said slide plate is an elongated hole to be penetrated by a screw unit connecting the handle rod to said combination tool head, on the rear end of the slide plate is a filling groove that opens to the inside, fixed inside said filling groove is one end of a horizontal spring, the other end of said spring being fixed to a hook hole on said one side wall; on the front end of said slide plate corresponding to an open end of said side wall is a catch plate; near an end part of the joining part of said combination tool head corresponding to the side of said positioning structure is a catch groove; when said combination tool head and said handle rod form a straight angle, said catch groove may be hooked by said catch plate to fix said combination tool head;

a rod-shaped tool set, composed of a number of rod-shaped tools having ends being jointly linked to a bolt rod, two ends of said bolt rod being fixed to each side wall at a second end of said handle rod; and a handle cover comprising a hollow unit, its side corresponding to an open side of said handle rod; one end of said handle cover being linked to approximately the center of the side walls of said handle rod; the inside of said handle cover having a number of semi-round accommodating grooves.

2. A wrench hammer set, as recited in claim 1, wherein, on one side near the end of the joining part of said combination tool head is a round groove inside which is squeezed a spring and a round ball; on the side wall of said handle rod corresponding to the location of said round ball being a small hole; when said combination tool head and said handle rod are extended horizontally, said round ball is limited and positioned in said small hole.

3. A wrench hammer set, as recited in claim 1, wherein, on the outside surface of said handle cover are a number of arched sections, when said handle cover covers the rear half of said handle rod, the handle cover forms a handle for the user to grip comfortably.

4. A wrench hammer set, as recited in claim 1, wherein, an illumining structure is installed at the end of the handle rod below said rod-shaped tool set.

5. A wrench hammer set, as recited in claim 1, wherein, said rod-shaped tool set comprises no less than one sleeve socket rod, no less than one slot-head screwdriver rod, no less than one Philip-head screwdriver rod and no less than one angle rod screwdriver.

* * * * *